US008555970B2

(12) United States Patent
Wheeler et al.

(10) Patent No.: US 8,555,970 B2
(45) Date of Patent: Oct. 15, 2013

(54) ACCELERATING THE START-UP PHASE FOR A STEAM ASSISTED GRAVITY DRAINAGE OPERATION USING RADIO FREQUENCY OR MICROWAVE RADIATION

(75) Inventors: Thomas J. Wheeler, Houston, TX (US); W. Reid Dreher, Jr., Katy, TX (US); Dwijen K. Banerjee, Owasso, OK (US)

(73) Assignee: ConocoPhillips Company, Houston, TX (US)

( * ) Notice: Subject to any disclaimer, the term of this patent is extended or adjusted under 35 U.S.C. 154(b) by 677 days.

(21) Appl. No.: 12/779,451

(22) Filed: May 13, 2010

(65) Prior Publication Data

US 2010/0294488 A1 Nov. 25, 2010

Related U.S. Application Data

(60) Provisional application No. 61/180,020, filed on May 20, 2009.

(51) Int. Cl.
*E21B 43/24* (2006.01)

(52) U.S. Cl.
USPC ..... 166/272.3; 166/248; 166/302

(58) Field of Classification Search
None
See application file for complete search history.

(56) References Cited

U.S. PATENT DOCUMENTS

| | | | |
|---|---|---|---|
| 4,144,935 | A | 3/1979 | Bridges et al. |
| 4,193,448 | A | 3/1980 | Jeambey |
| 4,620,593 | A | 11/1986 | Haagensen |
| 4,638,863 | A | 1/1987 | Wilson |
| 4,819,723 | A | 4/1989 | Whitfill et al. |
| 5,076,727 | A | 12/1991 | Johnson et al. |
| 5,082,054 | A | 1/1992 | Kiamanesh |
| 5,299,887 | A | 4/1994 | Ensley |
| 6,012,520 | A | 1/2000 | Yu et al. |
| 6,086,830 | A | 7/2000 | Kartchner |
| 6,284,105 | B1 | 9/2001 | Eliasson et al. |
| 7,312,428 | B2 | 12/2007 | Kinzer |
| 7,331,385 | B2 | 2/2008 | Symington et al. |
| 2007/0131591 | A1 | 6/2007 | Pringle |
| 2007/0246994 | A1 | 10/2007 | Kaminsky |
| 2007/0261844 | A1 * | 11/2007 | Cogliandro et al. ..... 166/248 |
| 2007/0289736 | A1 | 12/2007 | Kearl |
| 2008/0073079 | A1 | 3/2008 | Tranquilla |
| 2008/0087428 | A1 | 4/2008 | Symington |
| 2008/0190818 | A1 | 8/2008 | Dana |
| 2008/0207970 | A1 | 8/2008 | Meurer |
| 2008/0221226 | A1 | 9/2008 | Coutinho |
| 2008/0230219 | A1 | 9/2008 | Kaminskey |
| 2010/0078163 | A1 * | 4/2010 | Banerjee et al. ..... 166/248 |

FOREIGN PATENT DOCUMENTS

| | | |
|---|---|---|
| DE | 3813014 | 2/1989 |
| GB | 896407 | 5/1962 |
| WO | WO9610065 | 4/1996 |
| WO | WO2005093210 | 10/2005 |
| WO | WO2007084763 | 7/2007 |
| WO | WO2007099315 | 9/2007 |

* cited by examiner

*Primary Examiner* — Zakiya W Bates
(74) *Attorney, Agent, or Firm* — ConocoPhillips Company

(57) ABSTRACT

A method for preheating a formation prior to beginning steam assisted gravity drainage production. The method proceeds by forming a steam assisted gravity drainage production well pair within a formation. A preheating stage is then begun by injecting an activator into the formation. The preheating stage is then accomplished by exciting the activator with radio frequencies. This is followed by beginning the steam assisted gravity drainage operation.

13 Claims, 1 Drawing Sheet

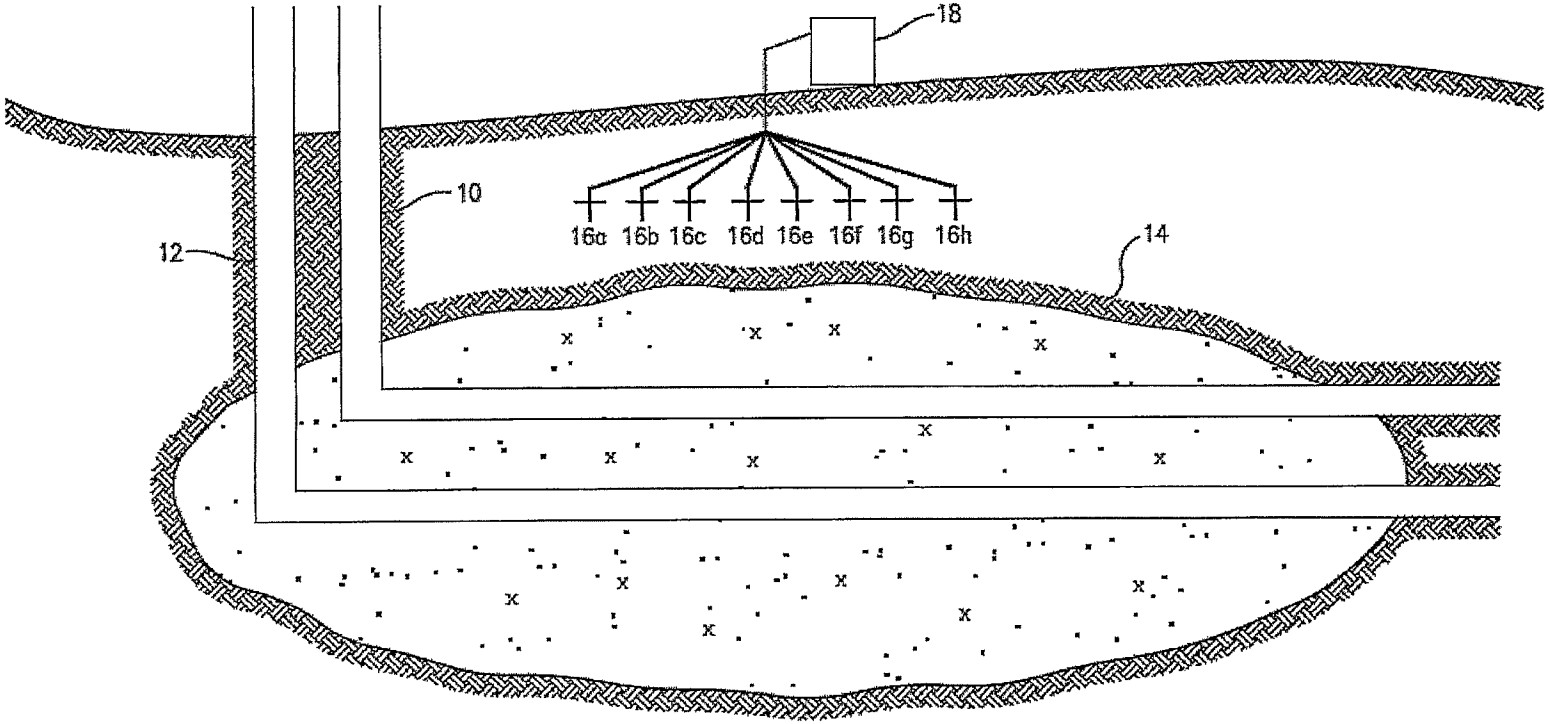
18
16a
16b
16c
16d
16e
16f
16g
16h
10
14
12

ACCELERATING THE START-UP PHASE FOR A STEAM ASSISTED GRAVITY DRAINAGE OPERATION USING RADIO FREQUENCY OR MICROWAVE RADIATION

CROSS-REFERENCE TO RELATED APPLICATIONS

None

STATEMENT REGARDING FEDERALLY SPONSORED RESEARCH OR DEVELOPMENT

None

FIELD OF THE INVENTION

A method for accelerating the start-up phase for a steam assisted gravity drainage operations.

BACKGROUND OF THE INVENTION

A variety of processes are used to recover viscous hydrocarbons, such as heavy oils and bitumen, from underground deposits. There are extensive deposits of viscous hydrocarbons around the world, including large deposits in the Northern Alberta tar sands, that are not amenable to standard oil well production technologies. The primary problem associated with producing hydrocarbons from such deposits is that the hydrocarbons are too viscous to flow at commercially relevant rates at the temperatures and pressures present in the reservoir. In some cases, such deposits are mined using open-pit mining techniques to extract the hydrocarbon-bearing material for later processing to extract the hydrocarbons.

Alternatively, thermal techniques may be used to heat the reservoir to produce the heated, mobilized hydrocarbons from wells. One such technique for utilizing a single horizontal well for injecting heated fluids and producing hydrocarbons is described in U.S. Pat. No. 4,116,275, which also describes some of the problems associated with the production of mobilized viscous hydrocarbons from horizontal wells.

One thermal method of recovering viscous hydrocarbons using two vertically spaced horizontal wells is known as steam-assisted gravity drainage (SAGD). SAGD is currently the only commercial process that allows for the extraction of bitumen at depths too deep to be strip-mined. By current estimates the amount of bitumen that is available to be extracted via SAGD constitutes approximately 80% of the 1.3 trillion barrels of bitumen in place in the Athabasca oilsands in Alberta, Canada. Various embodiments of the SAGD process are described in Canadian Patent No. 1,304,287 and corresponding U.S. Pat. No. 4,344,485. In the SAGD process, steam is pumped through an upper, horizontal, injection well into a viscous hydrocarbon reservoir while hydrocarbons are produced from a lower, parallel, horizontal, production well vertically spaced proximate to the injection well. The injector and production wells are typically located close to the bottom of the hydrocarbon deposit.

It is believed that the SAGD process works as follows. The injected steam creates a 'steam chamber' in the reservoir around and above the horizontal injection well. As the steam chamber expands upwardly and laterally from the injection well, viscous hydrocarbons in the reservoir are heated and mobilized, especially at the margins of the steam chamber where the steam condenses and heats a layer of viscous hydrocarbons by thermal conduction. The mobilized hydrocarbons (and aqueous condensate) drain under the effects of gravity towards the bottom of the steam chamber, where the production well is located. The mobilized hydrocarbons are collected and produced from the production well. The rate of steam injection and the rate of hydrocarbon production may be modulated to control the growth of the steam chamber to ensure that the production well remains located at the bottom of the steam chamber in an appropriate position to collect mobilized hydrocarbons. Typically the start-up phase takes three months or more before communication is established between horizontal wells. This depends on the formation lithology and actual interwell spacing. There exists a need for a way to shorten the pre-heating period without sacrificing SAGD production performance.

It is important for efficient production in the SAGD process that conditions in the portion of the reservoir spanning the injection well and the production well are maintained so that steam does not simply circulate between the injector and the production wells, short-circuiting the intended SAGD process. This may be achieved by either limiting steam injection rates or by throttling the production well at the wellhead so that the bottomhole temperature at the production well is below the temperature at which steam forms at the bottomhole pressure. While this is advantageous for improving heat transfer, it is not an absolute necessity, since some hydrocarbon production may be achieved even where steam is produced by the production well.

A crucial phase of the SAGD process is the initiation of a steam chamber in the hydrocarbon formation. The typical approach to initiating the SAGD process is to simultaneously operate the injector and production wells independently of one another to recirculate steam. The injector and production wells are each completed with a screened (porous) casing (or liner) and an internal tubing string extending to the end of the liner, forming an annulus between the tubing and the casing. High pressure steam is simultaneously injected through the tubings of both the injection well and the production well. Fluid is simultaneously produced from each of the production and injection wells through the annulus between the tubing string and the casing. In effect, heated fluid is independently circulated in each of the injection and production wells during this start-up phase, heating the hydrocarbon formation around each well by thermal conduction. Independent circulation of the wells is continued until efficient fluid communication between the wells is established. In this way, an increase in the fluid transmissibility through the inter-well span between the injection and production wells is established by conductive heating. Once efficient fluid communication is established between the injection and the production wells, the injection well is dedicated to steam injection and the production well is dedicated to fluid production. Canadian Patent No. 1,304,287 teaches that in the SAGD start-up process, while the production and injection wells are being operated independently to inject steam, steam must be injected through the tubing and fluid collected through the annulus, not the other way around. It is disclosed that if steam is injected through the annulus and fluid collected through the tubing, there is excessive heat loss from the annulus to the tubing and its contents, whereby steam entering the annulus loses heat to both the formation and to the tubing, causing the injected steam to condense before reaching the end of the well.

The requirement for injecting steam through the tubing of the wells in the SAGD start-up phase can give rise to a problem. The injected steam must travel to the toe of the well, and then migrate back along the well bore to heat the length of the horizontal well. At some point along the length of the well bore, a fracture or other disconformity in the reservoir may be encountered that will absorb a disproportionately large amount of the injected steam, interfering with propagation of the conductive heating front back along the length of the well bore.

U.S. Pat. No. 5,407,009 identifies a number of potential problems associated with the use of the SAGD process in hydrocarbon formations that are underlain by aquifers. The U.S. Pat. No. 5,407,009 teaches that thermal methods of heavy hydrocarbon recovery such as SAGD may be inefficient and uneconomical in the presence of bottom water (a zone of mobile water) because injected fluids (and heat) are lost to the bottom water zone ("steam scavenging"), resulting in low hydrocarbon recoveries. U.S. Pat. No. 5,407,009 also addresses this problem using a technique of injecting a hydrocarbon solvent vapour, such as ethane, propane or butane, to mobilize hydrocarbons in the reservoir.

There have been efforts to promote methods that reduce the start-up time in SAGD production such as U.S. Pat. No. 5,215,146. U.S. Pat. No. 5,215,146 describes a method for reducing the start-up time in SAGD operation by maintaining a pressure gradient between upper and lower horizontal wells with foam. By maintaining this pressure gradient hot fluids are forced from the upper well into the lower well. However, there exists an added cost and maintenance requirement due to the need to create foam downhole, an aspect that is typically not required in SAGD operation.

Other methods, such as WO 99/67503 initiate the recovery of viscous hydrocarbons from underground deposits by injecting heated fluid into the hydrocarbon deposit through an injection well while withdrawing fluids from a production well. WO 99/67503 teaches that the flow of heated fluid between the injection well and the production well raises the temperature of the reservoir between the wells to establish appropriate conditions for recovery of hydrocarbons.

Recently there have been interest in the use of heating with radio/microwave frequencies. The use of radio/microwave frequencies have been used in various industries for a number of years. For example microwave frequencies interact with molecules through a coupling mechanism. This coupling causes molecules to rotate and give off heat. Microwave radiation couples with, or is absorbed by, non-symmetrical molecules or those which possess a dipole moment. In cooking applications, microwaves are absorbed by water present in food. Once this occurs, the water molecules rotate and generate heat. The remainder of the food is then heated through a conductive heating process Hydrocarbons do not typically couple well with microwave radiation. This is due to the fact that these molecules do no possess a dipole moment. However, heavy crude oils are known to possess asphaltenes which are molecules with a range of chemical compositions. Asphaltenes are often characterized as polar, metal containing molecules. These traits that make them exceptional candidates for coupling with microwave radiation. By targeting these molecules with MW/RF radiation localized heat will be generated through dipole rotation generating heat which will induce a viscosity reduction in the heavy oil.

Heating with MW/RF frequencies is generally an absorptive heating process which results from subjecting polar molecules to a high frequency electromagnetic field. As the polar molecules seek to align themselves with the alternating polarity of the electromagnetic field, work is done and heat is generated and absorbed. When RF energy is applied to hydrocarbons which are trapped in a geological formation, the polar molecules, i.e., the hydrocarbons and connate water, are heated selectively, while the non-polar molecules of the formation are virtually transparent to the RF energy and absorb very little of the energy supplied.

The heat that is generated could then be utilized to heat the entire region between SAGD wellpairs, and could potentially decrease the startup time of a SAGD operation. At a field/development scale this would decrease the amount of water required in terms of steam-oil ratio (SOR) and green house gas emissions produced which have positive economic and environmental impacts. However difficulty arises when attempting to select the appropriate radio frequency to excite the asphaltene(s) since the chemical composition can vary greatly within a formation.

U.S. Pat. No. 4,144,935 attempts heat formations by limiting the range in which radio frequencies are used to heat a particular volume in a formation. By using variable microwave frequency, one can tune the microwave frequency generated within the formation to one that interacts best with the dipole moment present within the hydrocarbons. U.S. Pat. No. 5,055,180 also attempts to solve the problem of heating mass amounts of hydrocarbons by generating radio frequencies at differing frequency ranges.

There exists a need for an enhanced process that couples the use of microwave radiation to produce an enhanced hydrocarbon recovery within a heavy oil or bitumen reservoir.

SUMMARY OF THE INVENTION

A method for preheating a formation prior to beginning steam assisted gravity drainage production. The method proceeds by forming a steam assisted gravity drainage production well pair within a formation. A preheating stage is then begun by injecting an activator into the formation. The preheating stage is then accomplished by exciting the activator with radio frequencies. This is followed by beginning the steam assisted gravity drainage operation.

BRIEF DESCRIPTION OF THE DRAWINGS

The invention, together with advantages thereof, may best be understood by reference to the following description taken in conjunction with the accompanying drawings.

FIG. 1 depicts an embodiment wherein the activators are injected into a SAGD system.

DETAILED DESCRIPTION OF THE INVENTION

The current method teaches the ability to heat a formation. The method begins by forming a steam assisted gravity drainage production well pair within a formation. This is followed by beginning a preheating stage by injecting an activator into the formation. The preheating stage is accomplished by exciting the activator with radio frequencies. This preheating stage is then followed by a steam assisted gravity drainage operation.

By choosing specific activators to inject into the formation, one skilled in the art would have the requisite knowledge to select the exact radio frequency required to achieve maximum heating of the activator. Therefore the current method eliminates the need to arbitrarily generate variable microwave frequency which may or may not be able to efficiently absorb the microwave radiation. The activator ionic liquids chosen would have specific properties such as containing positively or negatively charged ions in a fused salt that absorbs MW/RF radiation efficiently with the ability to transfer heat rapidly.

Examples of activators include ionic liquid that may include metal ion salts and may be aqueous. Asymmetrical compounds selected for the microwave energy absorbing substance provide more efficient coupling with the microwaves than symmetrical compounds. In some embodiments, ions forming the microwave energy absorbing substance include divalent or trivalent metal cations. Other examples of activators suitable for this method include inorganic anions such as halides. In one embodiment the activator could be a metal containing compound such as those from period 3 or period 4 of the periodic table. In yet another embodiment the activator could be a halide of Na, Al, Fe, Ni, or Zn, including $AlCl_4^-$, $FeCl_4^-$, $NiCl_3^-$, $ZnCl_3^-$ and combinations thereof. Other suitable compositions for the activator include transitional metal compounds or organometallic complexes. The more efficient an ion is at coupling with the MW/RF radiation the faster the temperature rise in the system.

In one embodiment the added activator chosen would not be a substance already prevalent in the crude oil or bitumen. Substances that exhibit dipole motion that are already in the stratum include water, salt and asphaltenes.

In one embodiment a predetermined amount of activators, are injected into the formation through a wellbore or some other known method. Radio frequency generators are then operated to generate radio frequencies capable of causing maximum excitation of the activators. For some embodiments, the radio frequency generator defines a variable frequency source of a preselected bandwidth sweeping around a central frequency. As opposed to a fixed frequency source, the sweeping by the radio frequency generator can provide time-averaged uniform preheating of the hydrocarbons with proper adjustment of frequency sweep rate and sweep range to encompass absorption frequencies of constituents, such as water and the microwave energy absorbing substance, within the mixture. The radio frequency generator may produce microwaves that have frequencies ranging from 0.3 gigahertz (GHz) to 100 GHz. For example, the radio frequency generator may introduce microwaves with power peaks at a first discrete energy band around 2.45 GHz associated with water and a second discrete energy band spaced from the first discrete energy band and associated with the activator. Optionally, radio frequency generators can be utilized to excite pre-existing substances in the stratum that are capable of exhibiting dipole motion. Examples of these pre-existing substances include: water or salt water, asphaltenes or heavy metals.

In an alternate embodiment multiple activators with differing peak excitation levels can be dispersed into the formation. In such an embodiment one skilled in the art would be capable of selecting the preferred range of radio frequencies to direct into the activators to achieve the desired temperature range to mobilize the heavy oil and allow production.

In one embodiment the activators provide all the heat necessary to preheat the oil in the production well. In an alternate embodiment it is also possible that the activator supplements preexisting preheating methods in the formation.

The activators can be injected into the formation through a variety of methods as commonly known in the art. Examples of typical methods known in the art include injecting the activators via the oil producing well, and or the injection well.

The activators are able to preheat the stratum via conductive and convective mechanisms by the heat generation of the activators. In strata type environments the activators can be selectively placed in one stratum and excluded from another. One of the benefits of selectively placing the activators include the ability to heavily concentrate the amount of activators in a region thereby allowing the radio frequencies to heat one region before going to the next region.

Radio frequencies come from radio frequency generators that can be situated either above or below ground. The radio antennas should be directed towards the activators and can be placed either above ground, below ground or a combination of the two. It is the skill of the operator to determine the optimal placement of the radio antenna to achieve dipole moment vibration while still maintaining ease of placement of the antennas.

In non-limiting embodiment, FIG. 1 depicts a method of utilizing a method of preheating activators in a SAGD system. In this embodiment the activator is placed downhole either via the steam injection well 10 and/or the production well 12. Once the activators are in the stratum 14, radio antenna 16*a*, 16*b*, 16*c*, 16*d*, 16*e*, 16*f*, 16*g* and 16*h*, which are attached to a radio frequency generator 18, are used to heat the activators in the stratum 14. In this embodiment the activator is depicted with the symbol "x". Using such a method the activators assist in providing secondary preheating to the SAGD system during the SAGD process, or as a method of pre-heating the stratum to initiate the SAGD process.

FIG. 1 depicts the radio antennas in the stratum, however in an alternate embodiment the radio antennas can be within or along the injection well, within or along the production well or within or along both the injection well and the production well. In yet another embodiment the radio antennas can be placed above ground and merely directed underground.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A method comprising the steps of:

a) forming a steam assisted gravity drainage production well pair within a formation;

b) beginning a preheating stage by injecting an activator into the formation;

c) accomplishing the preheating stage by exciting the activator with microwave and/or radio frequencies; and d) beginning the steam assisted gravity drainage production.

2. The method of claim 1, wherein two or more microwave and/or radio frequencies are generated such that one range excites the activator and the other range excites existing constituents of the formation.

3. The method of claim 1, wherein the activator is injected into the formation in an aqueous solution.

4. The method of claim 1, wherein the activator is injected into the formation as a slurry.

5. The method of claim 1, wherein the activator is a halide compound.

6. The method of claim 5, wherein the halide compound comprises a metal from period 3 or period 4 of the periodic table.

7. The method of claim 1, wherein the activator is a metal containing compound.

8. The method of claim 1, wherein the activator comprises at least one of $AlCl4^-$, $FeCl4^-$, $NiCl3^-$ and $ZnCl3^-$.

9. The method of claim 1, wherein the activator is injected into the formation simultaneously via an injection well and a production well.

10. The method of claim 1, wherein the activator is injected into the formation via an injection well or a production well.

11. The method of claim 1, wherein the activator is injected into the producing stratum of a steam assisted gravity drainage system.

12. The method of claim 1, wherein the activator is injected into both the producing and non-producing stratum of a steam assisted gravity drainage system.

13. The method of claim 1, wherein the microwave and/or radio frequency is regulated to the range necessary to excite the activator.

* * * * *